United States Patent [19]

Marz

[11] 4,422,382

[45] Dec. 27, 1983

[54] EXPLOSIVE CONTAINER OF INTERCONNECTED THERMOPLASTIC FILM PACKAGES

[75] Inventor: Horst F. Marz, Otterburn Park, Canada

[73] Assignee: C-I-L Inc., North York, Canada

[21] Appl. No.: 195,344

[22] Filed: Oct. 8, 1980

[30] Foreign Application Priority Data

Oct. 24, 1979 [CA] Canada ..... 338324

[51] Int. Cl.[3] ..... F42B 3/02

[52] U.S. Cl. ..... 102/331; 102/323; 102/324; 206/3; 86/20 D

[58] Field of Search ..... 102/323, 324, 331; 86/20 D; 206/3

[56] References Cited

U.S. PATENT DOCUMENTS

| | | | |
|---|---|---|---|
| 2,764,939 | 10/1956 | Phemister | 102/324 |
| 2,911,910 | 11/1959 | Welsh, Jr. | 206/3 |
| 3,049,079 | 8/1962 | Eilo | 102/324 |
| 3,373,520 | 3/1968 | Into | 206/3 X |
| 3,731,625 | 5/1973 | Slawinski | 102/324 |
| 3,783,787 | 1/1974 | Thornley et al. | 102/324 X |
| 3,881,417 | 5/1975 | Mesia | 102/324 X |
| 3,921,529 | 11/1975 | McKee | 102/323 |
| 4,090,342 | 5/1978 | Rishel | 102/324 X |
| 4,161,142 | 7/1979 | Edwards et al. | 102/324 X |
| 4,205,611 | 6/1980 | Slawinski | 102/324 |
| 4,282,812 | 8/1981 | Forgey et al. | 102/324 X |

*Primary Examiner*—Peter A. Nelson

*Attorney, Agent, or Firm*—Donald G. Ballantyne

[57] ABSTRACT

A thermoplastic film package containing a blasting explosive is provided having utility in secondary blasting operations. The package comprises superimposed film panels joined along their periphery to form a bag and having closeable neck-like openings at opposite ends of the bag. The package lends itself to fabrication from flat film or sheet by heat-sealing techniques and may be filled with explosives on continuous packaging apparatus.

1 Claim, 5 Drawing Figures

EXPLOSIVE CONTAINER OF INTERCONNECTED THERMOPLASTIC FILM PACKAGES

This invention relates to a novel explosive package. More particularly, the invention relates to an improved package for explosives used in secondary blasting.

In secondary blasting, explosives are employed for the purpose of breaking up large pieces of rock in open pit operations or for the dislodgement of rock projections in underground workings and the like. Generally, in secondary blasting, an explosive charge is simply placed on the surface of the rock, jammed into a rock crevice or held against the rock by means of props or poles and thereafter detonated. In quarry operations, for example, a very large number of secondary blasts may be required to fragment boulders for subsequent crushing. Economy convenience, and the function of being easily shaped to the contour of the rock for a wide area of contact, therefore, are the principal requisites of any packaged explosive used in secondary blasting.

In the past, it has been customary to prepare secondary blasting charges from one or several cartridges of conventional dynamite or to employ dynamite compositions packaged in small bags. Alternatively, specially packaged bulk explosives can be employed. Such special bulk packages are disclosed, for example, in Canadian Pat. Nos. 941,674 and 835,662. While the explosive packages of the aforementioned patents go far towards economizing and improving secondary blasting operations, they have not solved all of the problems associated therewith. A disadvantage which may be mentioned with respect to the gathered-neck packages of the prior art is that the sausage-like shape of the packages and methods used to gather the film at the neck portion, reduces the area of the package which may be placed in contact with the rock. The package of Canadian Pat. No. 941,674 while having a square, wide-contact shape, is costly to manufacture since its valved filling openings do not lend themselves to a mechanized filling operation. There remains, therefore, a need for a yet further improved explosive package for secondary blasting, especially a package which provides economy of production with safety, convenience and explosive effectiveness.

It is the object of the present invention to provide an improved explosive package suitable for use in secondary blasting which may be economically manufactured yet which provides safe and efficient use in the field.

Other objects of the invention will be apparent hereinafter.

The improved explosive package of the invention comprises a bag-like container of thermoplastic film and a blasting explosive composition contained within said container, said container being substantially rectangular in plan shape and having two sealable filling openings at opposite ends of the said container for the introduction of blasting explosive therein.

The invention may be more fully understood by reference to the accompanying drawings wherein like numerals indicate like parts and wherein FIG. 1 shows a plan view of an explosive package made in accordance with the present invention;

Figure 1:
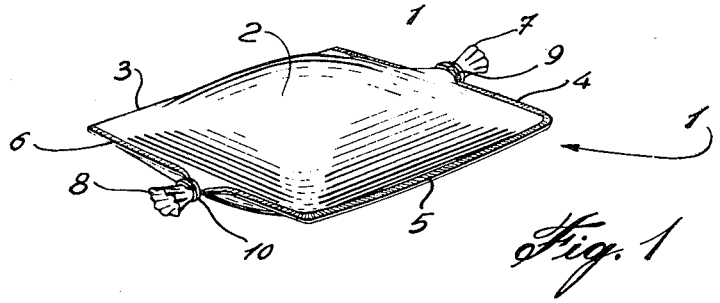

Referring to FIG. 1, there is shown a substantially rectangular pillow-like bag or container 1 containing an explosive composition. Bag 1 comprises superimposed plastic film panels, upper panel 2 being shown. Edge 3 comprises a folded edge of the plastic film while edges 4, 5 and 6, shown in heavy line, comprise heat-sealed edges. Two filling necks or openings 7 and 8 are shown along edges 4 and 6, which necks are sealed by means of clips or ties 9 and 10.

Figure 2:
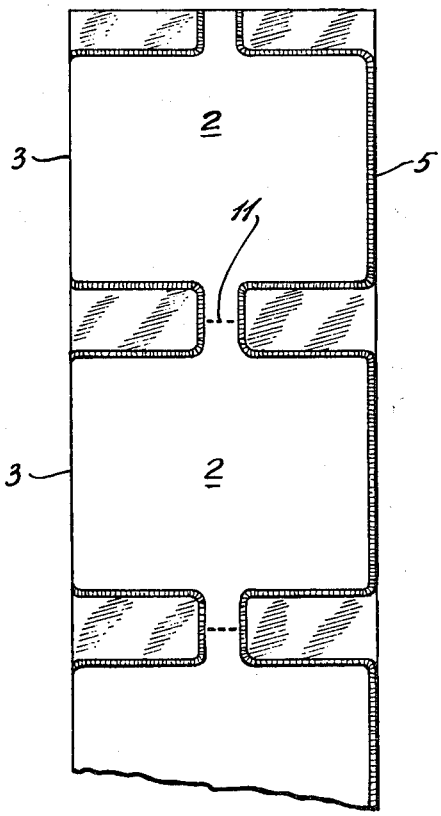
FIG. 2 shows a plan view of a folded plastic sheet with cut-out sections in hatched lines.
Figure 3:
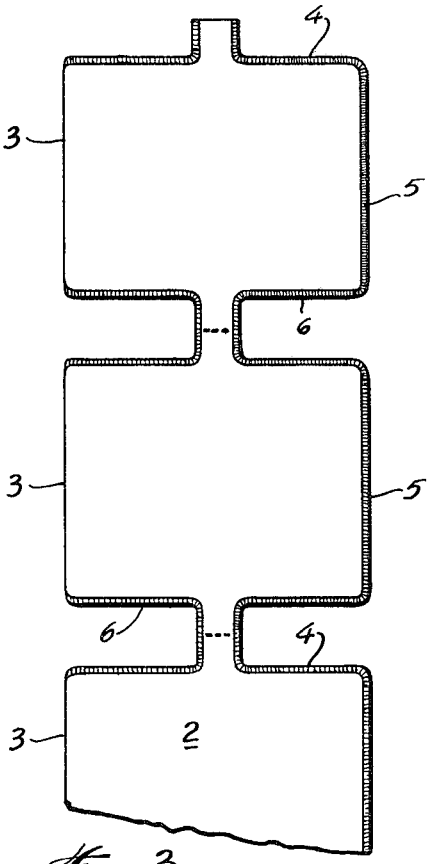
FIG. 3 shows the folded sheet of FIG. 2 sealed and cut to form.

Referring to FIGS. 2 and 3, longitudinal sheets of plastic film are shown folded along edge 3 and heat sealed along edge 5. The hatched areas in FIG. 2 represent portions of the overlapped film which may be simultaneously cut away and their edges heat sealed, the heat sealed edges being shown in heavy line. The dotted line 11 represents a point of division between adjacent bags or packages.

Figure 4:
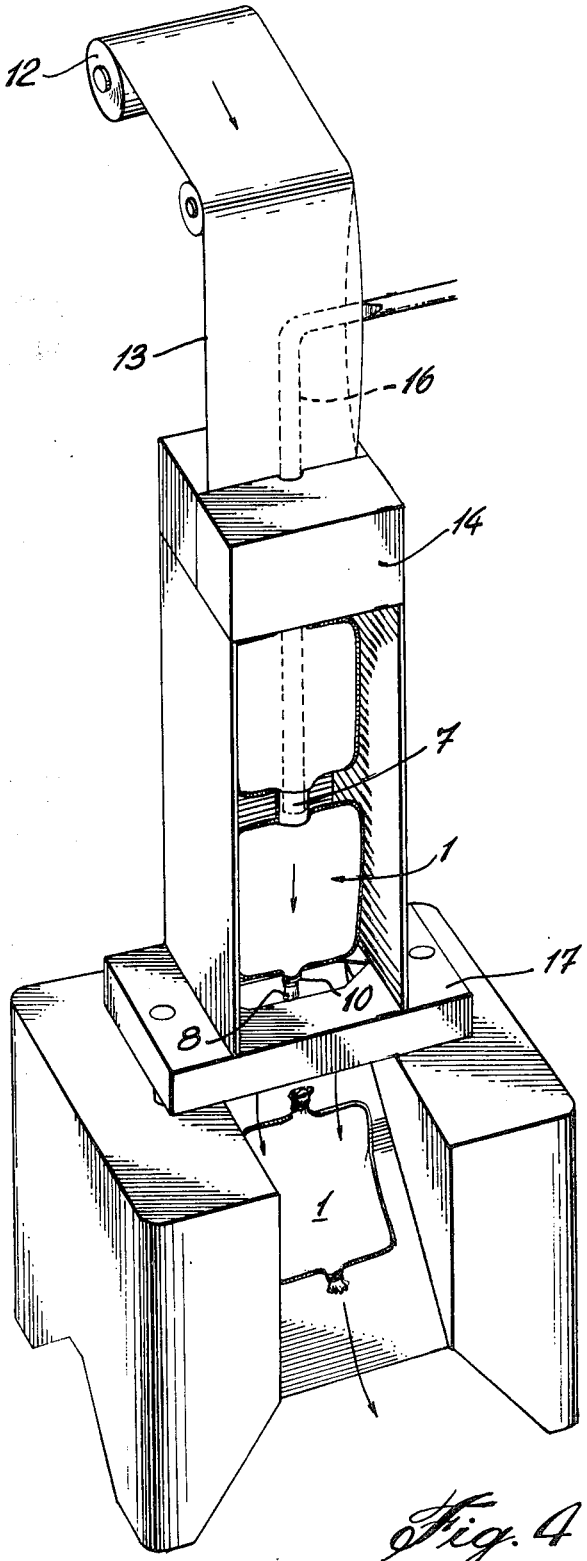
FIG. 4 shows packaging machine for the sealing, cutting and filling of the packages of FIG. 1.

With reference to FIG. 4, there is shown a stored roll of plastic film comprising a folded edge 13. The film is fed to a heat sealing unit 14 where a continuous elongated chain of empty containers as shown in FIG. 3 are shaped. A source of explosives 15 is fed under pressure into conduit 16 which conduit is adapted to feed explosives into neck opening 7 in container 1. The neck 8 in the opposite end of container 1 is sealed by, for example, a metal tie or clip 10 applied by clipper unit 17. After filling and clipping, the packages are cut at point 11 as shown in FIGS. 2 and 3 and are collected for further packaging.

Figure 5:
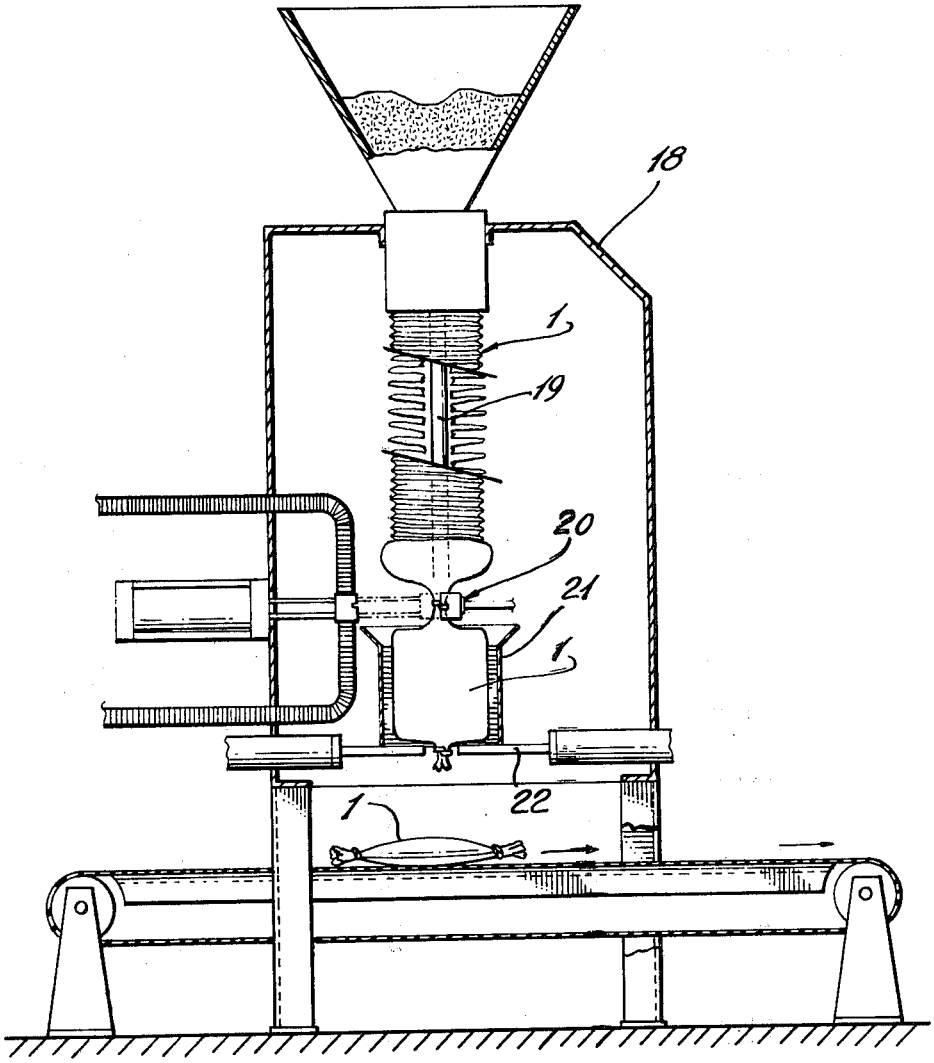
FIG. 5 shows an alternative form of packaging machine by which the packages of FIG. 1 may be produced.

FIG. 5 shows an alternative filling procedure where a connected length of empty containers as shown in FIG. 3 is shirred onto the filing tube or horn 19 of packing machine 18. A clipping and cutting device 20 provides top and bottom closures for the containers which are held in retainer 21 during filling. After filling, clipping and cutting, the filled containers are released by, for example, pneumatic piston 22 and are thence collected for further packaging. It will be obvious where it is desired to fill the containers of FIG. 3 by means of the procedure shown in FIG. 5 that the connected length of containers may be fabricated from a length of flattened tubular film with edges 3 and 5 both being folded edges.

While ammonium nitrate/fuel oil (ANFO) explosives may be used in the package of the invention, the preferred explosive for use is an aqueous slurry mixture comprising a thickened mixture of oxidizer salts and fuels dispersed in an aqueous solution of the salts. Such a composition is economic to manufacture and safe to use and is ideally suited to the aforedescribed container since it results in a package which is kneadable and which can be wedged into rock fissures or conformed to rock irregularities. Slurry explosives may also be packaged in the described container by simple extrusion methods as shown in FIGS. 4 and 5 thus to provide a package of high capacity. The resultant package resembles somewhat a dual ended hot water bottle.

The thermoplastic film employed in the container preferably has a thickness of from 1 to 2 mils and while double-ply film of, say, 1 mil in each ply may be used, no particular advantage is to be gained from so doing despite their improved tear resistance over single ply containers. A number of flexible plastic materials combining high tensile and tear strength are known which may be used in the construction of the container and which will suggest themselves to those skilled in the art. A preferred material of construction is polyethylene having a wall thickness of from about 1 to about 2 mils or greater.

Unlike the tubular end-gathered containers or packages of the prior art, the rectangular cut and edge-sealed package of the present invention provides a container having substantial contact area yet which retains kneadability for use in the field. Because the filling neck is square cut, the package may be filled nearly to capacity since little or no void space is required for the film gathering and sealing operation. This results in a firm yet moldable container particularly suited for many secondary blasting purposes.

I claim:

1. Blasting explosive packages in the form of a train of integrally connected individual containers, joined together in alignment by narrow neck-like tubular film channels and adapted for continuous and automatic filling with flowable explosive mixtures, the said individual containers comprising superimposed front and back rectangular panels of thermoplastic film edge-sealed around the panel periphery to form sealed compartments having top and bottom ends and opposed side edges, each of the said top and bottom ends of each compartment having a narrow, extended, neck-like, tubular thermoplastic film aperture near its mid point and integral with the said panels, the said neck-like tube providing a connecting channel between compartments from the top edge of one compartment to the bottom edge of an adjacent compartment, the said train of containers thus describing a continuous line of individual containers having narrow neck-like, connecting conduits therebetween.

* * * * *